US008100785B2

(12) United States Patent
Henning

(10) Patent No.: US 8,100,785 B2
(45) **Date of Patent: *Jan. 24, 2012**

(54) BASEBALL AREA PROTECTION SYSTEM AND METHOD

(75) Inventor: William W. Henning, Sarasota, FL (US)

(73) Assignee: Aer-Flo Canvas Products, Inc., Oneco, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/049,096

(22) Filed: Mar. 16, 2011

(65) Prior Publication Data

US 2011/0165974 A1 Jul. 7, 2011

Related U.S. Application Data

(60) Division of application No. 10/722,287, filed on Nov. 25, 2003, now Pat. No. 7,270,617, and a division of application No. 11/778,221, filed on Jul. 16, 2007, now Pat. No. 7,494,433, and a continuation of application No. 12/390,582, filed on Feb. 23, 2009.

(51) Int. Cl.
*A63C 19/12* (2006.01)

(52) U.S. Cl. ..... 473/504; 473/451; D6/592

(58) Field of Classification Search ..... 473/504, 473/451, 414, 458, 502; D6/592; 116/205; 273/444; D34/23; D21/608, 603; 83/102; 248/500

See application file for complete search history.

(56) References Cited

U.S. PATENT DOCUMENTS

| | | | | |
|---|---|---|---|---|
| 1,216,488 | A | | 6/1917 | Pfeiffer |
| 2,495,636 | A | | 1/1950 | Hoeltzel et al. |
| 2,543,381 | A | | 2/1951 | Rosenzweig |
| 2,706,056 | A | | 4/1955 | Talley et al. |
| 2,720,656 | A | * | 10/1955 | Allan, Jr. ..... 2/232 |
| 3,226,737 | A | * | 1/1966 | Kyle ..... 5/417 |
| 3,247,845 | A | | 4/1966 | Kennedy |
| 3,305,969 | A | | 2/1967 | Mattson |
| 3,374,964 | A | | 3/1968 | Carvotta |
| 3,487,832 | A | | 1/1970 | Spence |
| 3,534,880 | A | | 10/1970 | Washburn, Jr. et al. |
| 3,638,815 | A | | 2/1972 | Fincher |
| 3,691,005 | A | | 9/1972 | Butler |
| 3,702,139 | A | | 11/1972 | Chaffin |

(Continued)

FOREIGN PATENT DOCUMENTS

GB 2207357 A 2/1989

OTHER PUBLICATIONS

American Athletic. "Windscreens & Field Covers—American Athletic Baseball and Softball—Equipment, Pro." <http:// www.aaibaseball.com/covers.htm>. Jun. 2, 2002.

(Continued)

*Primary Examiner* — Gene Kim
*Assistant Examiner* — M Chambers
(74) *Attorney, Agent, or Firm* — Jacox, Meckstroth & Jenkins

(57) ABSTRACT

This invention relates to an integrally weighted baseball cover and system, method and apparatus for quickly delivering the cover and placing it onto an area of a baseball field, such as one or more of the infield areas, such as home base area, first base area, second base area, third base area, pitcher's mound area and/or bullpen areas.

33 Claims, 8 Drawing Sheets

U.S. PATENT DOCUMENTS

| | | | | | |
|---|---|---|---|---|---|
| 3,862,876 | A | * | 1/1975 | Graves | 428/83 |
| 3,944,094 | A | | 3/1976 | Compton | |
| 4,180,867 | A | | 1/1980 | Ridgeway, Jr. | |
| 4,272,575 | A | | 6/1981 | Egigian | |
| 4,295,777 | A | | 10/1981 | Bell et al. | |
| 4,580,372 | A | | 4/1986 | Osborn | |
| 4,590,714 | A | | 5/1986 | Walker | |
| 4,634,618 | A | * | 1/1987 | Greer et al. | 428/81 |
| 4,654,906 | A | | 4/1987 | Roberts | |
| 4,682,447 | A | | 7/1987 | Osborn | |
| 4,690,585 | A | | 9/1987 | Holmberg | |
| 4,699,164 | A | | 10/1987 | Pilney et al. | |
| D293,060 | S | | 12/1987 | Botbol | |
| 4,709,430 | A | * | 12/1987 | Nicoll | 5/417 |
| 4,711,407 | A | | 12/1987 | Boon | |
| D295,491 | S | | 5/1988 | Drumheller | |
| 4,780,351 | A | | 10/1988 | Czempoyesh | |
| 4,798,754 | A | | 1/1989 | Tomek | |
| 4,889,446 | A | | 12/1989 | Holmberg | |
| 4,906,503 | A | | 3/1990 | De La Cruz et al. | |
| 4,910,855 | A | * | 3/1990 | Balarzs | 29/426.4 |
| 4,961,981 | A | | 10/1990 | Keegan | |
| 5,116,014 | A | * | 5/1992 | Slavens et al. | 248/500 |
| 5,141,200 | A | * | 8/1992 | Sherman et al. | 248/500 |
| 5,195,828 | A | | 3/1993 | Bush-Rodriquez | |
| 5,226,464 | A | | 7/1993 | Solov | |
| 5,261,131 | A | * | 11/1993 | Kilby | 5/419 |
| 5,308,670 | A | | 5/1994 | Saylor | |
| 5,364,156 | A | | 11/1994 | Zerow | |
| 5,379,555 | A | | 1/1995 | Strieb et al. | |
| 5,389,116 | A | | 2/1995 | Byrd | |
| 5,407,723 | A | | 4/1995 | Curtin | |
| 5,456,566 | A | | 10/1995 | Kniley et al. | |
| 5,499,411 | A | * | 3/1996 | Wong | 5/417 |
| 5,579,610 | A | | 12/1996 | Jackson | |
| 5,605,009 | A | | 2/1997 | Elder | |
| D379,081 | S | | 5/1997 | Wilson | |
| D389,451 | S | | 1/1998 | Wilson | |
| 5,769,106 | A | | 6/1998 | Achuff | |
| D406,080 | S | | 2/1999 | Marr | |
| D414,643 | S | | 10/1999 | Phua | |
| D419,042 | S | | 1/2000 | Price | |
| 6,077,587 | A | | 6/2000 | Potok | |
| 6,165,591 | A | | 12/2000 | Krauss | |
| D440,833 | S | | 4/2001 | Tanner | |
| 6,363,661 | B1 | | 4/2002 | Myers | |
| 6,394,528 | B2 | | 5/2002 | Hoenack | |
| 6,432,555 | B1 | | 8/2002 | Sikka et al. | |
| D477,376 | S | | 7/2003 | O'Dell et al. | |
| 7,270,617 | B2 | * | 9/2007 | Henning | 473/504 |
| 7,494,433 | B2 | * | 2/2009 | Henning | 473/504 |
| 2009/0203473 | A1 | * | 8/2009 | Henning | 473/504 |

OTHER PUBLICATIONS

Austintown Fence Company. "Austintown Fence Company: Product Catalog." <http://www.afencecompany.com>. Dec. 2, 2001.

BSN Sports. "esportsonline—9013." <http://www.ssgecom.com>. Sep. 2, 2001.

Cover Sports USA. "Athletic Field Cover—Cover Sports USA". <http://www.coversports.biz/fieldsaver.html>. Nov. 24, 2002.

Covermaster Inc. "Covermaster—Masters in the Art of Sports Surface Covers—Seat covers, Windscreens." <http:// www.covermaster.com>. Aug. 2, 2002.

Douglas Industries. "Douglas Field Covers & Infield Grass Protectors." <http://www.Douglas-sports.com/BsCovers.htm>. Nov. 27, 2001.

Hoover Fence Co. "Baseball/Softball—Field Maintenance Equipment." <http://www.hooverfence.com/sports/bseball-softball/tarps.htm>. Jan. 3, 2003.

J.A.Cissel Mfg. Co. "Courtmaster Baseball Field Covers & Fencing." <http://www.jacissel.net>. Nov. 7, 2001.

Mid America Sales Associates. Your Total Sport Source. "Shop Baseball." <http://www.masa.com>. May 3, 2002.

M.Putterman. "M. Putterman Vinyl Covers" <http://www.mputterman.com/vinyl.shtml>. Sep. 19, 2001.

Missouri Turf Paint and Field Graphics. "Field Covers for Baseball & Softball." <http://www.missouriturfpaint.com/baseball_cb.html>. Sep. 19, 2003.

NexTag. NexTag search results for Collegiate Pacific Products. <http://www.nextag.com>. Feb. 9, 2002.

Online Sports.Com "20' Circular Ultra-Lite Pitcher's Mound Cover from Collegiate Pacific." <http://www.onlinesports.com>. Feb. 9, 2002.

ProMounds, Inc. "Baseball Field Covers." <http://www.baseballmounds.com/fieldcovers.htm>. Oct. 3, 2002.

SportsMaster. "Baseball/Athletic Field Covers." <http://www.sportmasterinc.com/baseball_athletic.htm>. Aug. 11, 2003.

VPI Field Covers and Fencing. "VPI Field Covers and Fences." <http://www.sport2000.net.VPIfieldcovers_fencing.html>. Feb. 2, 2001.

WeatherBeater by Colorado Lining. "CLI's WeatherBeater Athletic Field Covers and Products." <http://coloradolining. com/weatherbeater>. Jan. 2, 2002.

Fence-Top Protection. "Baseball Field Covers—Windscreens." CoverSports USA. Philadelphia, PA 2001 Brochure (with attached Dealer Cover Pricing Jan. 1, 2002).

* cited by examiner

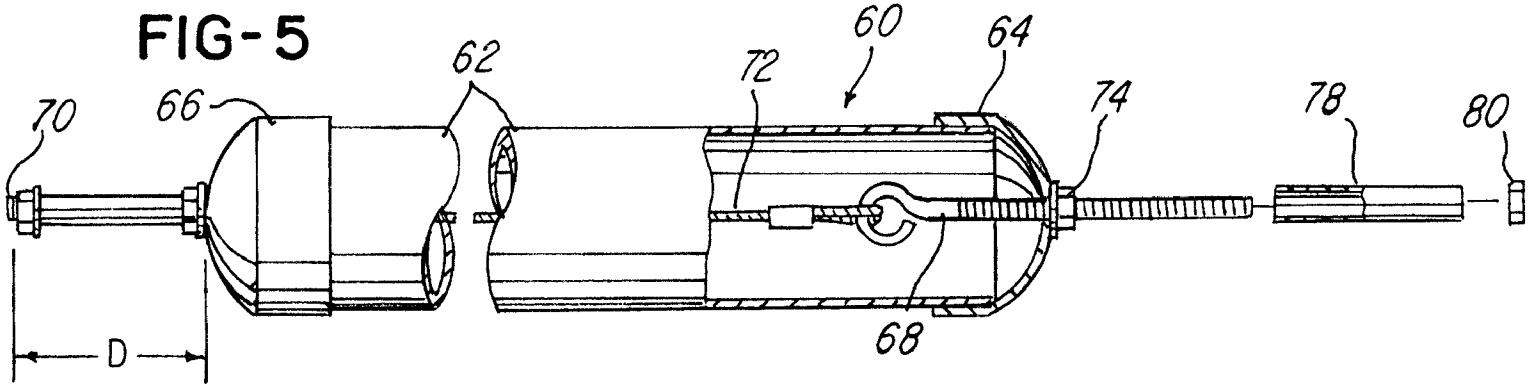
FIG-5
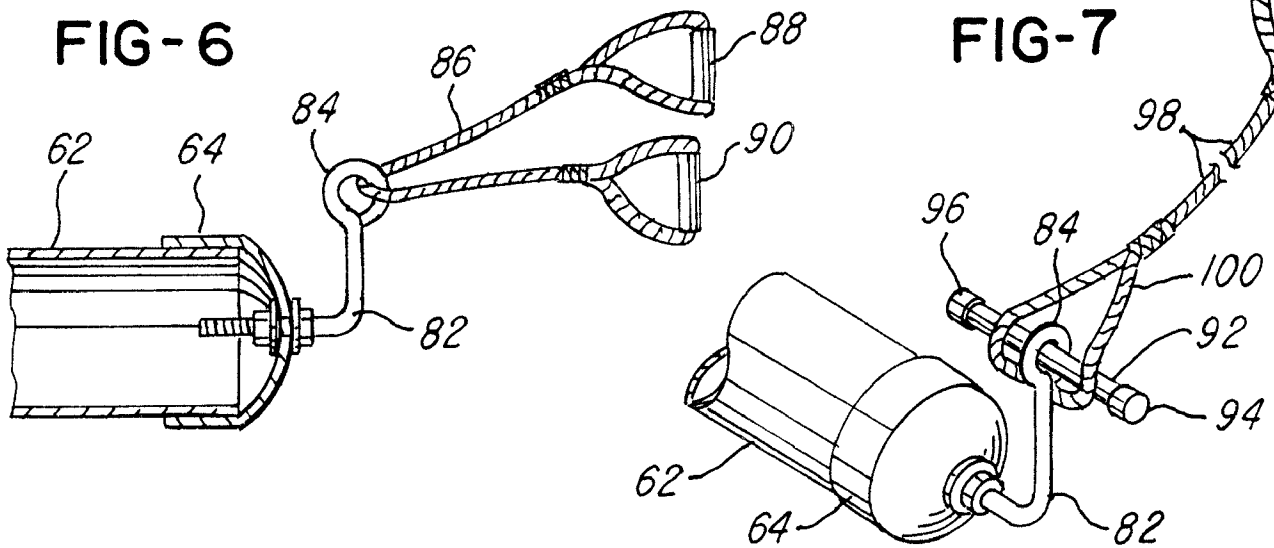
FIG-6
FIG-7

106
104
108
82
84
62
64
63
65
67
60
71
73
75
79

BASEBALL AREA PROTECTION SYSTEM AND METHOD

CROSS-REFERENCE TO RELATED APPLICATIONS

This application is a continuation of U.S. patent application Ser. No. 12/390,582 filed Feb. 23, 2009, which is a division of U.S. patent application Ser. No. 11/778,221, filed Jul. 16, 2007, now issued as U.S. Pat. No. 7,464,433, which is a division of U.S. patent application Ser. No. 10/722,287 filed Nov. 25, 2003, now issued as U.S. Pat. No. 7,270,617, which are incorporated herein by reference and made a part thereof.

BACKGROUND OF THE INVENTION

1. Field of the Invention

The invention relates to baseball and, more particularly, to a baseball cover and protection system and method and apparatus for delivering the cover to an area to be covered.

2. Description of the Related Art

Invented in 1845, the game of baseball is a sport that revolves around a one-on-one competition between pitcher and batter. In both the throwing and hitting efforts, each player is exerting force with their feet against the ground at various areas on the baseball field or infield. For example, a pitcher takes a giant step forward from the top of the pitcher's mound during the throwing motion, and his front foot must have good traction to stop his motion. As is well known, a batter takes a forceful step during the hitting motion and must have good traction in both hitting and his first few steps in running toward first base. Both the pitcher and batter could be injured if they lose their traction during their motions.

Most of the areas, such as the batter's box, pitcher's mound, first base, second base and third base, are either dirt or artificial dirt surfaces. If these surfaces get too wet and slippery, the baseball game may have to be stopped to protect the players. For this and other reasons, when rain begins during a baseball game, these areas must be covered with a water barrier cover with the pitcher's mound, the batter's box and general area around home plate being the most important.

In the past, waterproof tarps have been laid over these areas, or in some cases, over the entire infield or entire field itself. Rain is usually accompanied by wind. Oftentimes, the wind caused the tarps to be blown off the areas they were intended to cover, which exposed the dirt areas underneath. In the past, there were generally two methods to keep the baseball tarps in place during such conditions. One method was to place heavy objects, such as sandbags, rocks, or bricks on the tarps. Another method was to drive stakes through the tarp or through grommet holes provided in the tarp and into the ground. Both of these methods are slow and cumbersome ways to install and return a baseball tarp over an area to be covered. These methods also were somewhat time consuming in that it took several people to first lay the tarp and then hold it down while the weights or stakes were put in place. Then, more time was required to place the weights or to drive the stakes into the ground.

Because of the slow installation procedure, the areas that were not yet covered were typically getting wet. Also, until the tarp was sufficiently weighted or staked, the tarp edges were being blown up, which caused any exposed dirt areas to get wet or wetter.

In the area of professional baseball, huge tarps covered the entire field or large portions of it. These tarps were stored on large rolls and typically required several men to unroll and distribute the tarp over the entire playing field. Obviously, this required a comparable number or even more men or machines to remove the tarp from the field after the rain stopped and it was desired to resume play. These approaches did not enable selective and quick placement of covers or tarps over just the critical areas and without the need for the use or placement of separate weights.

What is needed, therefore, is a cover and delivery and protection system and method that enable the quick delivery and covering of one or more areas to be covered.

SUMMARY OF THE INVENTION

It is an object of the invention to overcome the shortcomings of the systems and methods of the past. This invention provides, among other things, an apparatus, system and method for quickly installing a baseball cover or tarp that has weighted material integrated directly therein, thus providing ballast that keeps the baseball cover in position during windy conditions and thereby eliminates the need for separate weights.

Another object is to provide a delivery system that enables the storage of the cover and quick delivery of the cover to an area to be covered and which also permits the cover to be quickly placed over an area to be covered.

Another object is to provide a cover having weights integrally stored in the cover.

Still another object is to provide a delivery system that is easy to lift and move and also easy to roll.

In one aspect, this invention comprises a baseball playing area cover comprising a flexible material having a perimeter that defines a predetermined configuration and a weight associated with the flexible material for retaining the flexible material in a desired position after the cover has been situated on a baseball playing area.

In still another aspect, this invention comprises a method for protecting an area of a baseball field, the method comprising the steps of determining the area of the baseball field to be covered, adapting a flexible material to have a configuration that corresponds to the area of the baseball field to be covered, forming the flexible material into the configuration to provide a cover and causing weight to be retained in the flexible material, the weight retaining the flexible material on the area after the cover has been situated on the area.

These and other objects and advantages of the invention will be apparent from the following description, the accompanying drawings and the appended claims.

BRIEF DESCRIPTION OF THE DRAWINGS

FIG. 5 is a fragmentary sectional view illustrating a delivery system comprising a roll for storing and delivering the cover shown in FIG. 2, for example;

FIG. 6 is a fragmentary sectional view showing an L-shaped I bolt and a tool for lifting and moving the roll shown in FIG. 5;

FIG. 7 is a fragmentary view showing another embodiment illustrating a tool for lifting a moving the roll;

DETAILED DESCRIPTION OF THE INVENTION

Figure 1:
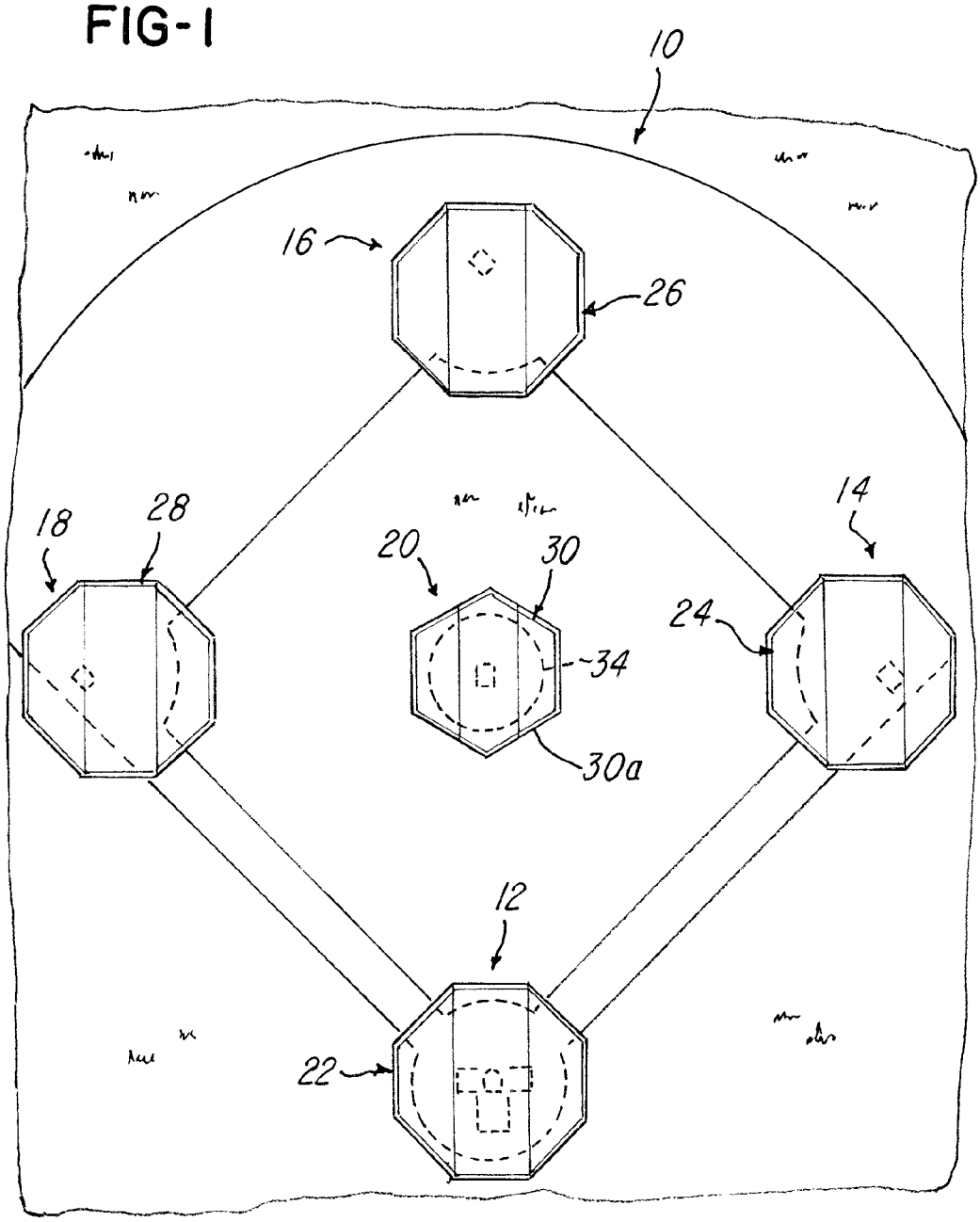
FIG. 1 is a fragmentary view illustrating a playing field with covers or tarps of the present invention.

FIG. 1 illustrates a baseball field 10. The baseball field 10 comprises a plurality of baseball playing areas, such as home plate area 12, first base area 14, second base area 16, third base area 18 and baseball mound area 20 as shown. The invention referred to and described herein provides means, system, apparatus and method for quickly delivering and placing a tarp or cover to these baseball playing areas 12-20 in order to protect them, for example, from rain, wind, debris and the like. It should be appreciated that the cover of the present invention may be useful to protect other areas, such as a bull pen, on-deck area or other areas associated with the baseball field 10.

The invention comprises at least one or a plurality of tarps or covers 22, 24, 26, 28 and 30 illustrated in FIG. 1. For ease of description and illustration, the cover 30 will be described in detail herein, but it should be understand that the covers 22-28 are similarly constructed.

Figure 2:
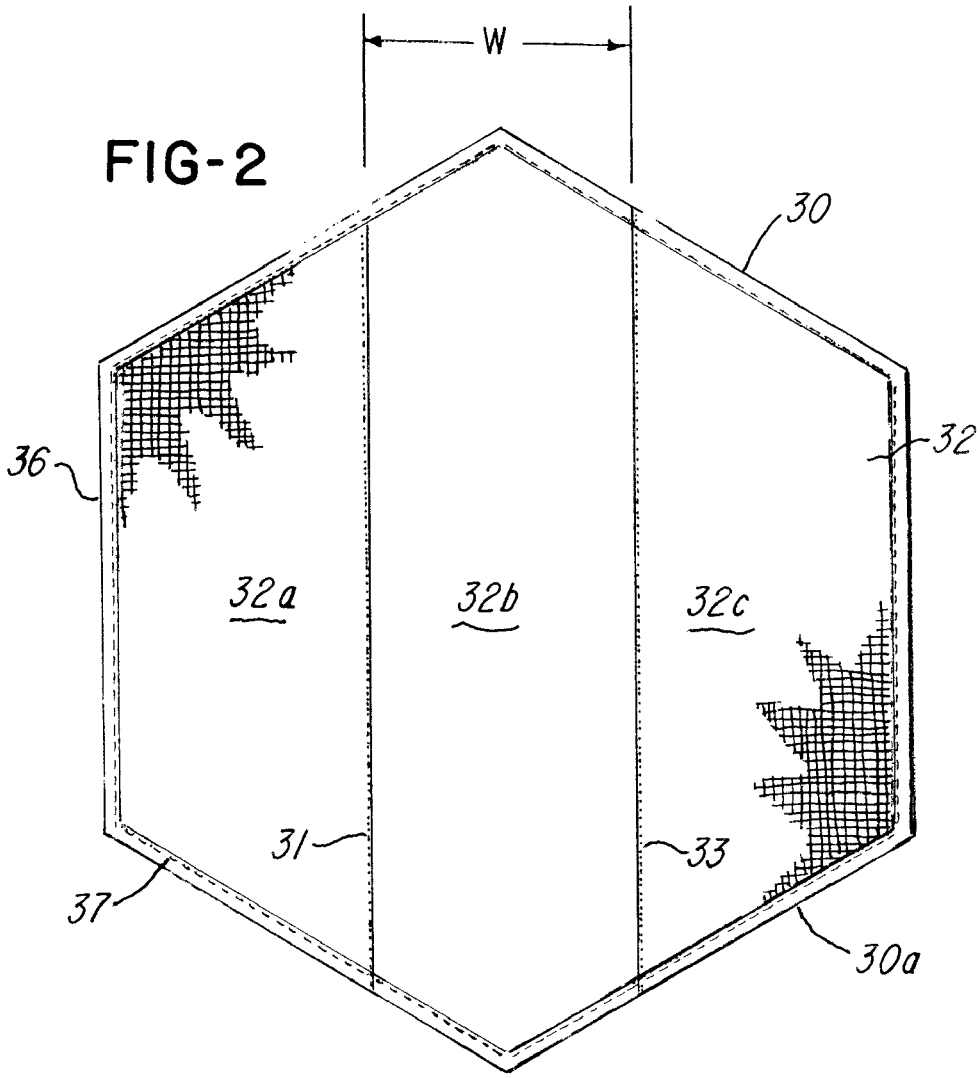
FIG. 2 is a plan view of an illustrative cover of the invention.

Referring now to FIG. 2, the cover 30 comprises a flexible material 32 of one or more layers, which in the embodiment being described is water-resistant and durable polymer material, such as a vinyl laminated (or coated) polyester; polyethylene sheet or woven polyethylene; a vinyl laminated or coated onto a polyester scrim fabric; a vinyl sheet; a vinyl laminated to a polymer woven scrim fabric; a vinyl coated polymer woven scrim; a vinyl laminated or coated onto any receptive fabric scrim; or a polymer laminated or coated onto any receptive fabric scrim. In the embodiment being described, the flexible material 32 is flexible in order to permit the flexible material 32 to conform to the shape of the surface on which it is placed. For example, if the flexible material 32 is situated on the baseball mound area 20 (FIG. 1), the cover 30 will conform to the shape of the mound, thereby reducing or eliminating any air gaps between a surface 30*a* (FIG. 2) of the cover 30 and the ground on which it rests. It has been found that this flexibility is also convenient if, for example, the cover 30 is used to protect baseball areas or baseball objects other than those illustrated in FIG. 1, such as a bull-pen, warm-up area, on-deck area, seating areas, baseball equipment, supplies and the like.

Figure 4A:
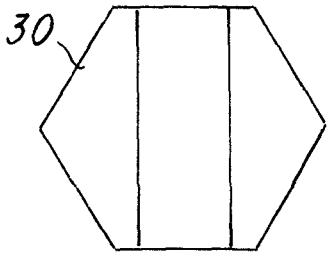
FIGS. 4A-4L are various views illustrating the cover formed of various polygonal or other configurations and also illustrating the seams between various sections.
Figure 4B:
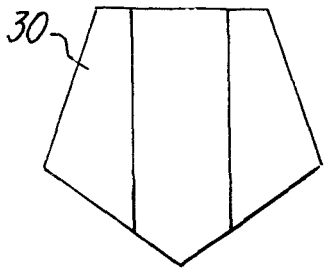
Figure 4C:
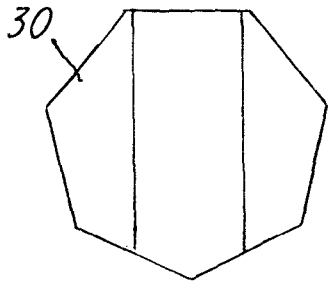
Figure 4D:
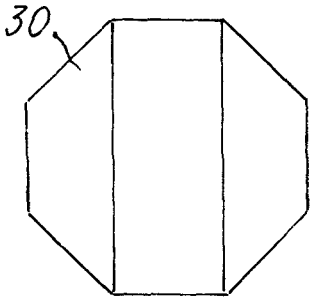
Figure 4E:
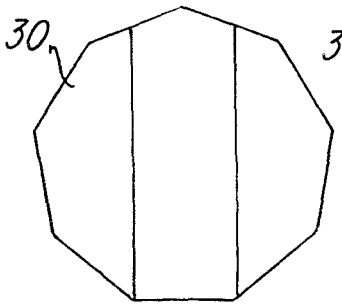
Figure 4J:
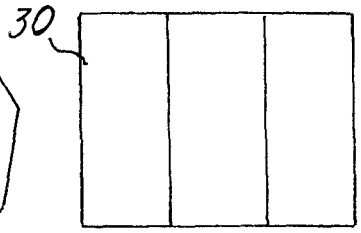
Figure 4F:
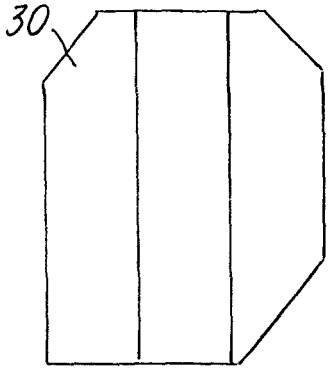
Figure 4G:
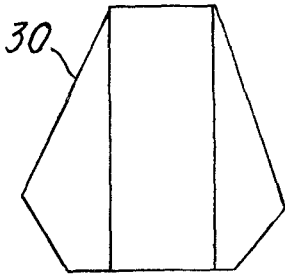
Figure 4K:
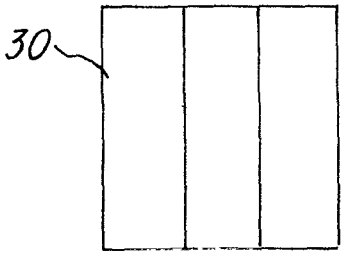
Figure 4H:
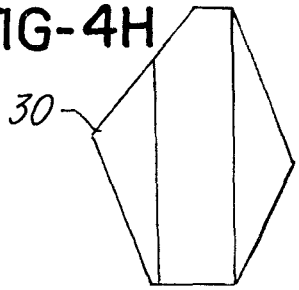
Figure 4I:
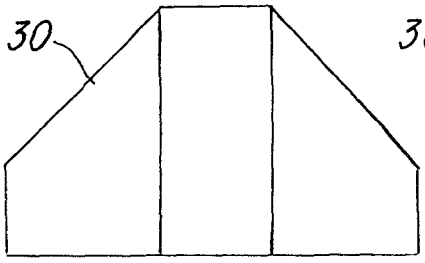
Figure 4L:
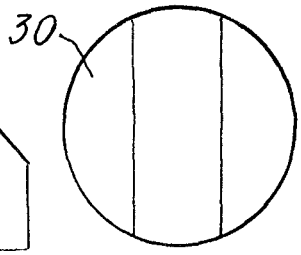

Referring back to FIG. 2, notice that the flexible material 32 comprises a perimeter 36 that defines a predetermined shape, such as a hexagonal shape as shown in FIG. 2. It should be understood, however, that the predetermined configuration or shape may comprise any desirable shape, such as the illustrative shapes shown in FIGS. 4A-4L. It has been found that multi-sided or polygonal shapes, such as the shapes shown in FIGS. 4A-4K are easiest to construct because they may be formed from strips or sections, such as sections or strips 32*a*, 32*b* and 32*c* (FIG. 2), of flexible material 32 as described later herein. As illustrated in FIGS. 4A-4E and 4K, the shapes may be equilateral, such as the equilateral hexagon in FIG. 4A, pentagon in FIG. 4B, or octagon in FIG. 4D. Alternatively, the predetermined configuration may be of a nonequilateral polygonal or multi-sided shape, such as those illustrated in FIGS. 4F-4I. The predetermined configuration may define a rectangle (FIG. 4J), square (FIG. 4K) or circle (FIG. 4L). The predetermined configuration may be selected in response to the shape of the area to be protected by the cover 30. A dimension for a typical cover may be 18 feet average diameter for a pitcher's mound cover and 26 feet average diameter for a home base cover.

Figure 3A:
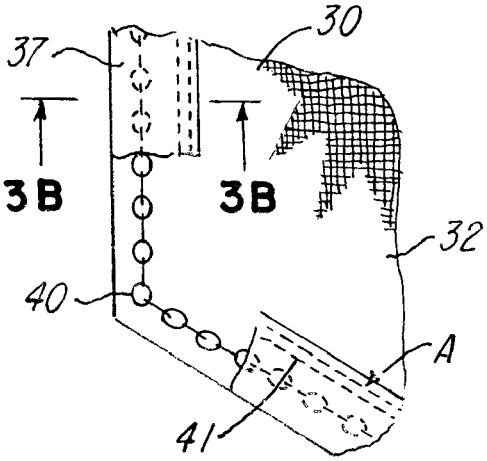
FIG. 3A is a fragmentary view showing various features of the cover and an integral weight.
Figure 3B:
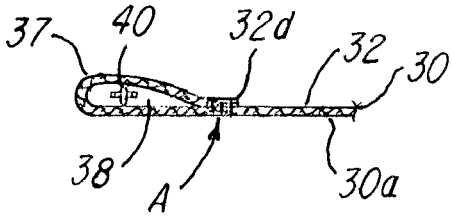
FIG. 3B is a sectional view taken along the line 3B-3B in FIG. 3A.

As illustrated in the FIGS. 3A-3B, the cover 30 comprises a weight retained directly in the cover 30 and suitable for providing weight 40 and ballast to the flexible material 32 so that, for example, it is resistant to movement by rain or winds yet is light enough so that the cover 30 can be installed easily and quickly. As illustrated in FIGS. 3A and 3B, the flexible material 32 is folded over itself to define a channel, pocket or weight-receiving area 38 (FIG. 3B) that receives the weight 40. In the embodiment being described, the weight 40 comprises a chain which is approximately 0.63 pounds/foot one-fourth inch grade 30 long link proof coil chain as specified in Federal Specification RR-C-271 and ASTM/ANSI 413. It should be appreciated that the weight 40 may comprise any suitable weight for providing ballast to the cover 30, and may comprise, for example, a chain, pellets, sand, earth, rock, concrete, aggregate, polymer, or even a second fabric, or any suitable weight so long as the weight 40 provides suitable ballast to provide the desired amount of wind resistance for the cover 30.

Figure 16:
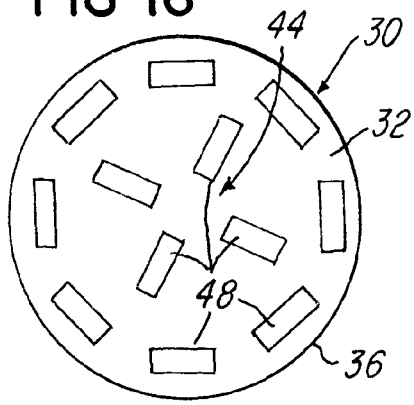
FIG. 16 is a view illustrating a plurality of weight-receiving areas in intervals and also in an interior within the perimeter of the cover.

As illustrated in FIG. 3B, the flexible material 32 comprises an end 32*d* that is folded over itself to provide a hem 37 as illustrated. The end 32*d* of flexible material 32 is secured at the area A (FIG. 3B) by sewn thread 41 or alternatively by a heat seal or weld which permanently secures and integrally forms the end 32*d* to the cover 30, thereby defining the hem 37 that integrally retains weight 40. As illustrated in FIG. 2, the hem 37 may extend around the entire perimeter 36 of the cover 30. Alternatively and as illustrated in FIGS. 15-18, the weight-receiving area 38 and weight 40 may be provided in any desired arrangement, such as in intervals 39 (FIG. 15) along the perimeter 36 or interior of the perimeter 36, such as in an interior area 44 (FIG. 16) of the cover 30. As illustrated in FIG. 16, a plurality of interior weight-receiving areas or pockets 48 may be provided within the perimeter 36 of the flexible material 32 in order to weight a central section 32*b* (FIG. 2) of the cover 30 as shown. Alternatively, a single interior weight-receiving area or pocket 50 (FIGS. 17A and 17B) may be formed using a second layer 35 of flexible material 32 that is welded to surface 32*e*. The pocket 50 being dimensioned to receive the weight 40 as shown.

Figure 18A:
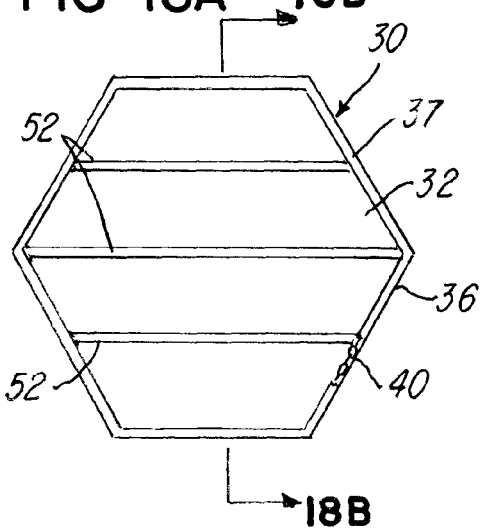
FIGS. 18A-18B illustrate another embodiment of the invention, showing a plurality of elongated channels extending between points on a perimeter of the cover.
Figure 18B:
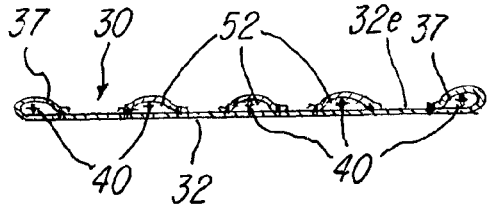

As illustrated in FIGS. 18A and 18B, the cover 30 may further be provided with a plurality of elongated weight-receiving areas 52 extending across a top surface 32*e* of cover 30 or between two points on the perimeter 36. The areas 52 may be arranged in a starburst configuration, with each area 52 receiving the weight 40.

Figure 17A:
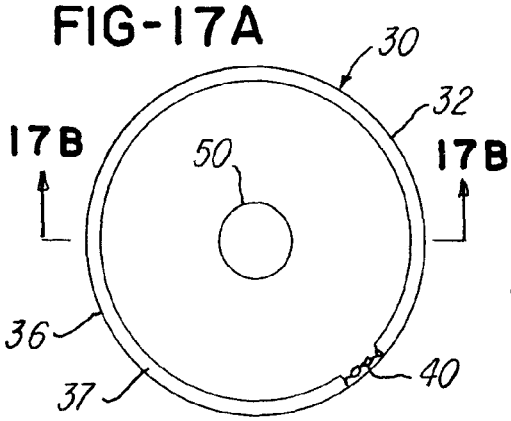
FIGS. 17A-17B illustrate another embodiment of the invention.
Figure 17B:
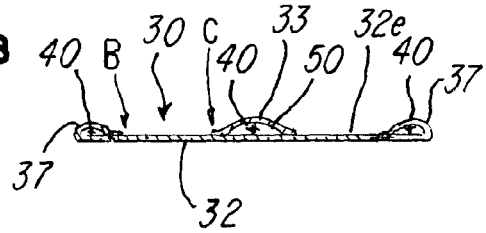

Thus, it should be appreciated that one feature of the invention is to provide at least one or a plurality of weight-receiving areas 38, 48, 50, 52 or a combination of weight-receiving areas 38, 48, 50, 52 of any desired shape, size or pattern. The areas 38, 48, 50 and 52 may extend continuously or in intervals and can be formed and shaped with desired dimensions or configurations in arcuate or curved segments or even in an endless configuration, such as is illustrated in the covers shown in FIGS. 2, 17A and 17B. Thus, although the weight-receiving areas 38, 48, 50, and 52 have been shown as arcuate or elongated, they could be any desired shape, such as a triangle or circle, as illustrated by the area 50 shown in FIGS. 17A and 17B. It has been found that the size and configuration of the areas, such as areas 38 in FIGS. 3B and 50 in FIG. 17B, will depend upon the size and amount of weight that is desired to be provided in the cover 30, which in turn, will depend upon the application and location where the cover 30 will be used. The selection of the shape and size of the weight-receiving areas has been made possible by the novel use of industrial sewing and/or heat welding to seal these areas in the flexible material 32. In the embodiment being described, the seal at the areas A in FIGS. 3B and B and C in FIG. 17B is provided by industrial sewing. Although the embodiment has been shown using a sewn seal, it should be understood that other means for creating the weight-receiving area may be used, such as by heat welding or RF welding the flexible material 32 or using an adhesive at the areas indicated by arrows A (FIG. 3B), B (FIG. 17B) and C.

As alluded to earlier, the cover 30 may be made from a single sheet of flexible material 32 which has one or more layers, or it may also be manufactured from a plurality of segments or strips of elongated flexible material 32, such as the sections or strips 32*a*, 32*b* and 32*c* (FIG. 2) that are joined at seams 31 and 33 by a heat weld or seal. In the embodiment described, the cover 30 is manufactured from a supply or roll of material (not shown) having a width W (FIG. 2) on the order of about six feet.

In another embodiment of the invention, a baseball tarp delivery system 60 is provided. The baseball tarp delivery system 60 will now be described relative to FIGS. 5-14. The baseball tarp delivery system 60 comprises a roll 62 having a pair of end caps 64, 66. The roll 62 and end caps 64 and 66 comprise PVC tubing having a diameter of at least four inches. Also, to facilitate shipping, the roll 62 may be provided in sections, such as sections 63 and 65 shown in FIG. 10. The sections 63 and 65 may be joined by an interior aluminum or PVC section 67 having an outer diameter that is slightly smaller than the inside diameter of the section 63 and 65. These sections 63, 65 and 67 may be aligned together using marks 71, 73 and 75 and then secured together with suitable means, such as an adhesive or screws 79.

The end caps 64 and 66 (FIG. 5) each comprise an eyebolt 68 and 70, respectively, which are coupled together by tensioning means, such as a cable 72 as shown. In one embodiment, the eyebolts 68 and 70 extend a distance D from the end caps 64 and 66 as shown. As illustrated with the end cap 64, a nut 74 secures the eyebolt and a PVC tube 78 is situated over the eyebolt 68. A second nut 80 is screwed onto the eyebolt 68 to retain the PVC tube 78 thereon. This construction provides a convenient and simple first member, tool, gripper, handle or means for lifting an end of the roll 62. One feature of this embodiment, as will be described later herein, is that it provides a first member, handle, gripper or means for lifting the roll 62, but also provides a second member, gripper, puller or means for moving the roll 62, for example, when it is on the ground.

Figure 11:
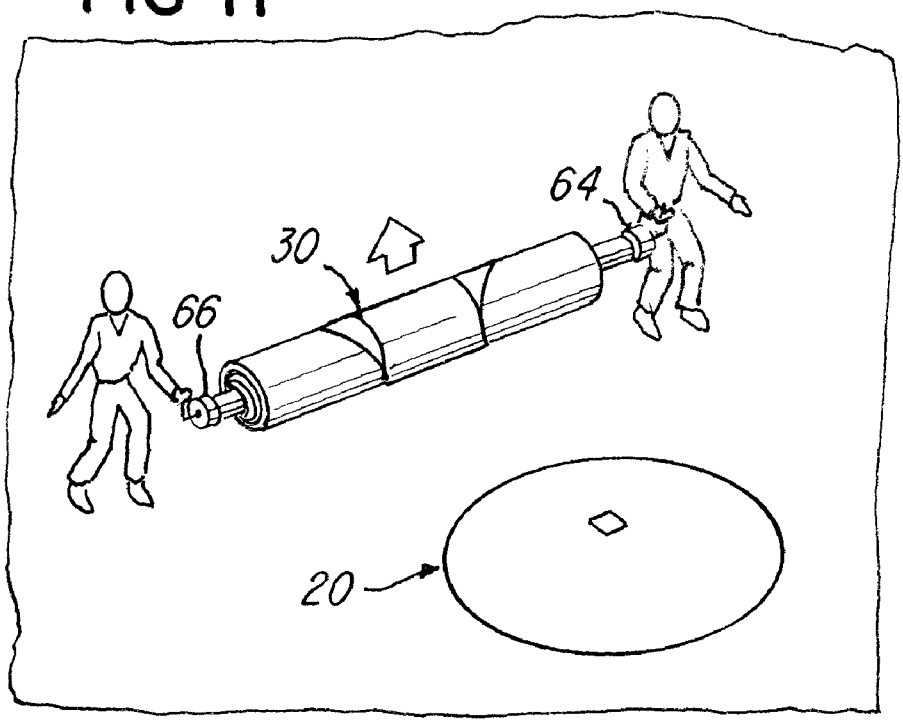
FIG. 11 is an illustration showing use of the tools and lifting of the roll so it can be carried to an area to be covered, such as a pitcher's mound area.
Figure 12:
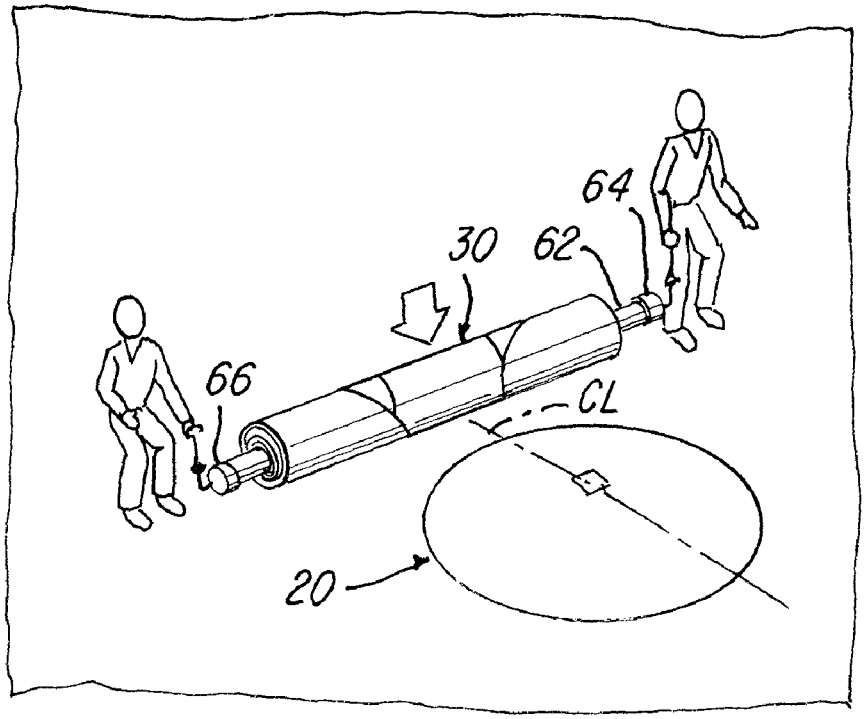
FIG. 12 illustrates the roll being placed on the ground adjacent to the pitcher's mound.

A method for delivery will now be described. As illustrated in FIGS. 11-14, the cover 30 is rolled up and stored on the roll 62, as shown in FIG. 11. Typically, the roll 62 and cover 30 are stored off the baseball field 10 and away from the baseball playing areas 12-20 during play. When it is desired to cover an area, such as the baseball mound area 20 in the illustration shown in FIGS. 11-14, the end caps 64 and 66 are lifted and the roll 62 and cover 30 are raised off of the ground and transported or carried to the baseball mound area 20 and then situated such that a center line CL (FIG. 12) of the baseball mound area 20 is approximately midway between the end caps 64 and 66 as illustrated in FIG. 12. The roll 62 and cover 30 are then lowered or situated on the ground as shown in FIG. 12.

Figure 13:
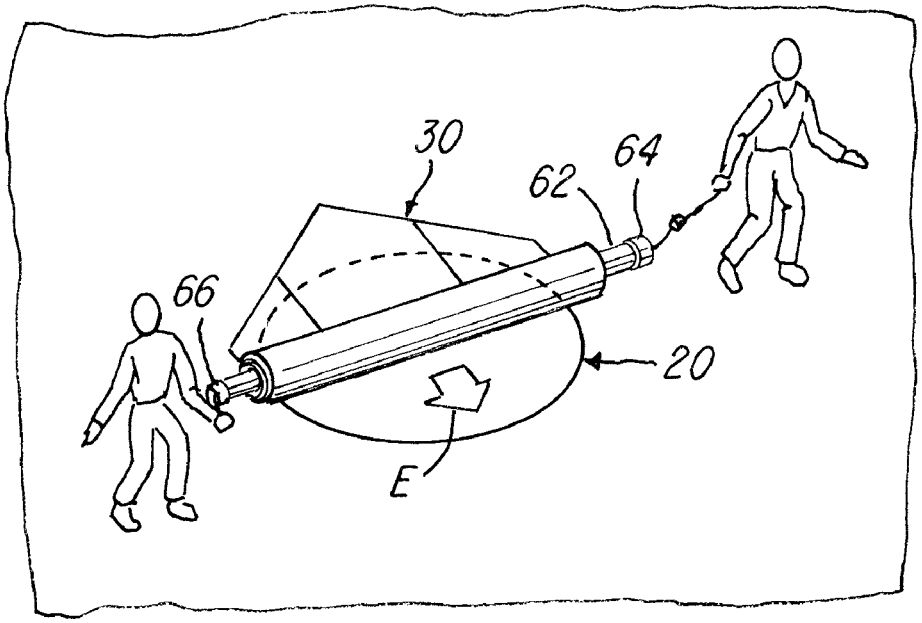
FIG. 13 further illustrates use of the tool to deliver the cover onto the pitcher's mound.
Figure 14:
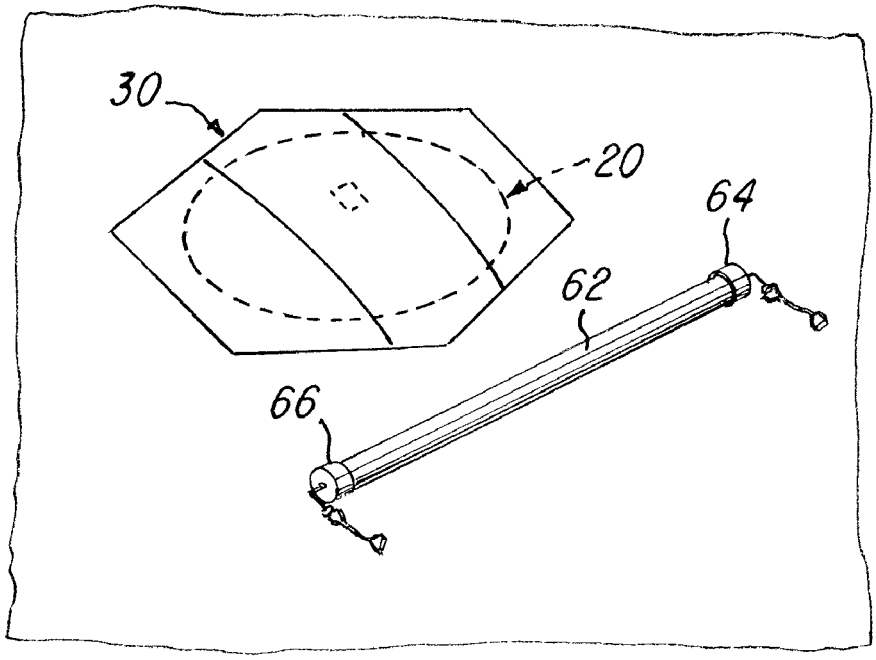
FIG. 14 illustrates the cover situated on the pitcher's mound after using the roll and tools.
Figure 15:
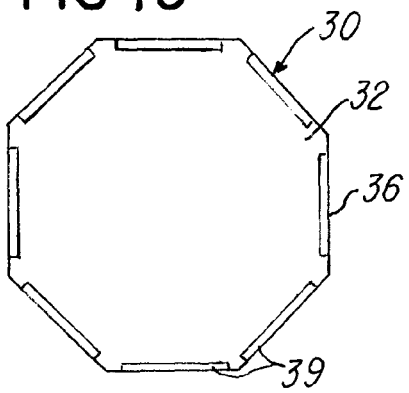
FIG. 15 illustrates a plurality of pockets or weight-receiving areas for receiving weights, with the areas being situated in intervals around a perimeter of the cover.

As illustrated in FIGS. 13-14, the cover 30 is delivered or unrolled off the roll 62 as the roll 62 is moved in the direction of arrow E in FIG. 13. The process may be reversed to take up the cover 30 onto the roll 62, for example, when it is desired to store the roll 62 and cover 30 off the baseball field 10.

To facilitate lifting the cover 30 and unrolling it as described, the first member, tool, gripper or handles defined by the ends of the eyebolts 68 and 70 may be used to lift the roll 62 and move the roll 62, for example, when rolling or unrolling the cover 30 from the roll 62. In one embodiment illustrated in FIG. 6, a tool 86, such as a braided member, rope, leash, chain or the like, may be used. In the illustration shown in FIG. 6, the tool 86 may comprise a pair of handles 88 and 90. The tool 86 may comprise a length such that when both handles 88 and 90 are grabbed by the user, they are short enough to permit the user to lift the roll 62 and cover 30 off the ground and carry it as illustrated in FIG. 11. After the roll 62 and cover 30 are situated on the ground adjacent to the baseball mound area 20 as shown in FIG. 12, one of the handles 88 or 90 may be released and the other simply pulled by the user as illustrated in FIG. 13 until the cover 30 has been dispensed from the roll 62. In this illustration, the eyelet 84 is selected to comprise a dimension such that when one of the handles 88 or 90 is pulled, the other handle will not slip through the eyelet 84.

FIG. 7 provides another illustration where a rod or tubular member 92 may be situated through the eyelet 84 as shown and then capped with end caps 94 and 96 to provide the first member, gripper handle or means for lifting the roll 62. Thus, the member 92 provides a handle that may be gripped when it is desired to lift the roll 62. A second member, puller or tool 98, such as a braided member, rope, leash, chain, or the like, may be provided with a hook (not shown) or loop 100 that can be looped around the rod 92 as shown in FIG. 7. A handle 102 on the braided member 98 may be pulled by a user as illustrated in FIG. 13, for example, to move the roll 62 in order to place the cover 30 onto the baseball mound area 20.

Figures 8, 9, 10:
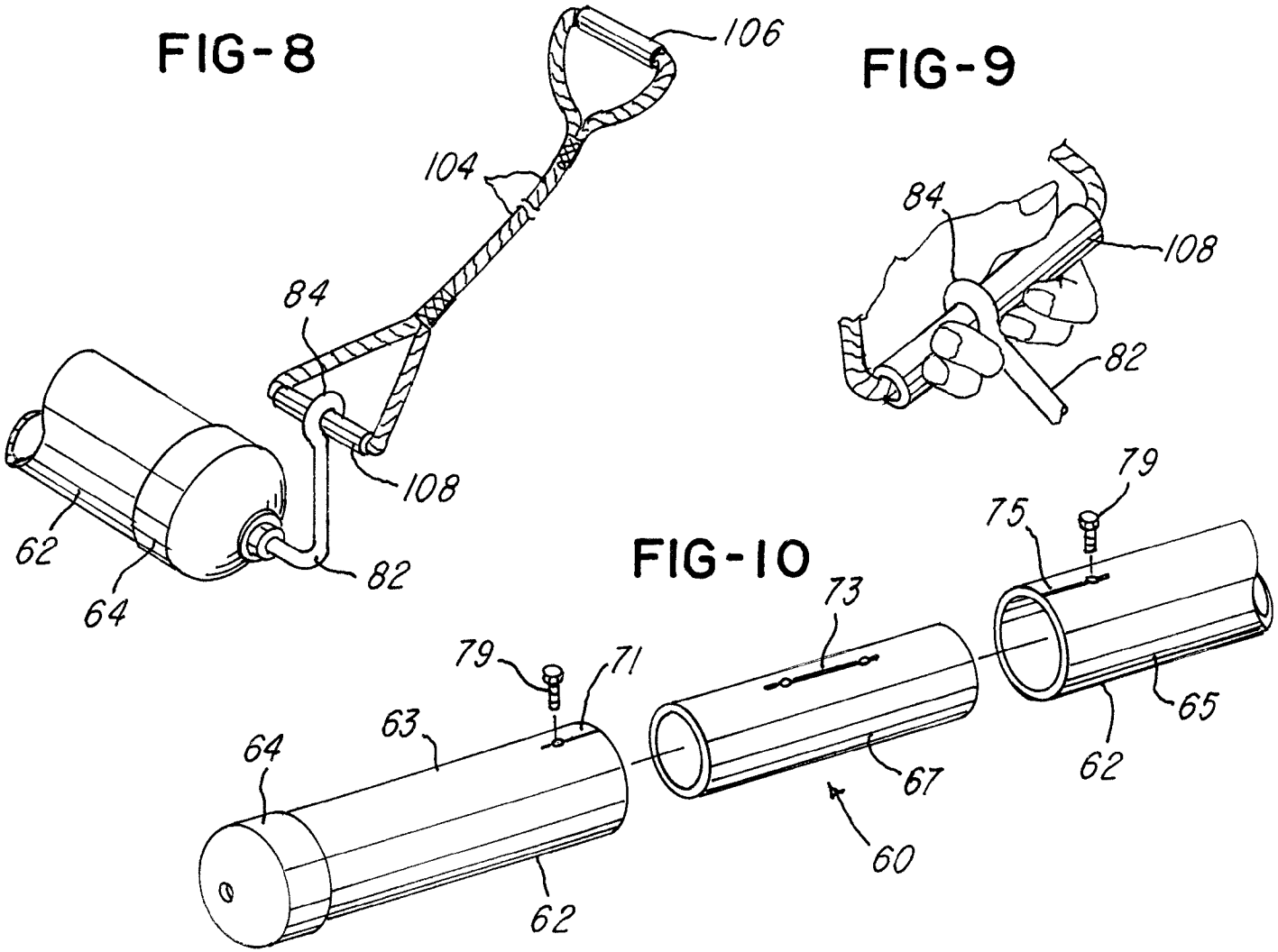
FIG. 8 is a fragmentary view illustrating another embodiment showing a tool for lifting and moving the roll.
FIG. 9 is a view showing the use of the tool shown in FIG. 8.
FIG. 10 shows an exploded view and approach for aligning and coupling two elongated sections to provide the roll shown in FIG. 5.

FIG. 8 illustrates still another approach wherein a tool 104 comprises a first member or handle 108 being received in the eyelet 84. The handle 108 may be grabbed and lifted when it is desired to lift and carry the roll 62 as shown in FIG. 11. The handle 106 may then be used to pull and roll the roll 62 such as when it is desired to place the cover 30 over the baseball mound area 20, as illustrated in FIGS. 13 and 14.

This system, method and apparatus provide convenient means for storing the cover 30 and also for quickly delivering and placing the cover 30 on an area, such as the baseball playing areas 12-20. The baseball tarp delivery system 60 may be used to quickly dispense and deliver the cover 30 to the area to be covered, as illustrated in FIGS. 11-14. Because the cover 30 comprises the weight which is retained, for example, in the perimeter 36 of the cover 30, the cover 30 is stable and resistant to undesired movement, such as movement caused by wind or rain. Further, the baseball tarp delivery system 60 provides protection for the areas, such as baseball mound area 20 illustrated in FIGS. 11-14, so that they do not become wet when it rains because the flexible material 32 is water resistant as mentioned earlier.

Advantageously, this invention provides an improved self-weighted baseball tarp and cover 30 and installation apparatus and method that is easy to use and enables a user to quickly deliver the cover 30 to an area to be covered such as when a rainstorm occurs suddenly. It should be appreciated that the roll 62 has been illustrated storing or comprising a single cover 30, but it should be understood that multiple covers 30 could be stored on a single roll 62. This enables quick delivery of covers 30 to a plurality of areas to be covered, such as the baseball playing areas 12-20 shown in FIG. 1.

Further, the invention provides self-weighting that eliminates the following problems/efforts required in the use of stakes and/or sandbags for ballast:

Separate storage of stakes or sandbags.

Loss of stakes or sandbags.

Damage to power motor when it hits stakes accidentally left in the ground when removing tarp.

Filling and sealing of sandbags before use.

Spilling of sand from sandbags during use.

Safety problem for person driving stakes.

Need for hammer or other implement to drive stakes.

While the method, system and apparatus described herein, constitute preferred embodiments of this invention, it is to be understood that the invention is not limited to this precise method, system and apparatus, and that changes may be made in either without departing from the scope of the invention, which is defined in the appended claims.

What is claimed is:

1. A baseball playing area cover in combination with and for use on an area of a baseball field, said baseball playing area cover comprising;

a flexible material having a perimeter that defines a predetermined configuration; and a weight associated with said flexible material for retaining said flexible material in a desired position on said area of the baseball field after said baseball playing area cover is situated on said area of the baseball field, so that said baseball playing area cover protects said area of the baseball field from at least one of wind, rain or debris after the baseball playing area cover has been situated on said area of the baseball field, said weight being situated at or proximate to said perimeter;

said predetermined configuration being adapted to generally complement or conform to a configuration or area defined by said area of the baseball field;

said baseball playing area cover storing or being coupled to said weight and also being portable so that when a user moves said flexible material between said area of the baseball field and a storage area, the user substantially simultaneously moves said weight in unison with said baseball playing area cover.

2. The baseball playing area cover as recited in claim 1 wherein said baseball playing area is an infield area.

3. The baseball playing area cover as recited in claim 2 wherein said predetermined configuration is selected in response to said area of the baseball field to be covered.

4. The baseball playing area cover as recited in claim 3 wherein said predetermined configuration is a polygonal shape.

5. The baseball playing area cover as recited in claim 4 wherein said predetermined configuration is a trapezoid.

6. The baseball playing area cover as recited in claim 1 wherein said weight is received between plys of said flexible material that define a weight-receiving area.

7. The baseball playing area cover as recited in claim 6 wherein said weight-receiving area extends continuously around said perimeter.

8. The baseball playing area cover as recited in claim 7 wherein said weight-receiving area defines a spiral interior of said perimeter in said flexible material.

9. The baseball playing area cover as recited in claim 6 wherein said flexible material comprises a heat seal to define said weight-receiving area and to retain said weight in said weight-receiving area.

10. The baseball playing area cover as recited in claim 6 wherein said flexible material is sewn to define said weight-receiving area and to retain said weight in said weight-receiving area.

11. The baseball playing area cover as recited in claim 6 wherein a plurality of separate weight-receiving areas are provided in said perimeter in intervals.

12. The baseball playing area cover as recited in claim 6 wherein said weight-receiving area extends at least partly around said perimeter and further comprise at least one interior weight-receiving area extending toward a center area of said flexible material.

13. The baseball playing area cover as recited in claim 6 wherein a plurality of separate weight-receiving areas are provided in said perimeter in intervals.

14. The baseball playing area cover as recited in claim 6 wherein said a flexible material is folded onto itself and heat sealed or sewn to define said weight-receiving area.

15. The baseball playing area cover as recited in claim 6 wherein said weight is comprises at least one of a chain, pellets, sand, earth, rock, concrete, aggregate, polymer, a second fabric.

16. The baseball playing area cover as recited in claim 6 wherein said flexible material comprises vinyl laminated polyester; coated polyester; polyethylene sheet or woven polyethylene; a vinyl laminated or coated onto a polyester scrim fabric; a vinyl sheet; a vinyl laminated to a polymer woven scrim fabric; a vinyl coated polymer woven scrim; a vinyl laminated or coated onto any receptive fabric scrim; or a polymer laminated or coated onto any receptive fabric scrim.

17. The baseball playing area cover as recited in claim 1 wherein said predetermined configuration defines a polygonal shape.

18. The baseball playing area cover as recited in claim 17 wherein said polygonal shape defines a pentagon, hexagon or octagon.

19. The baseball playing area cover as recited in claim 17 wherein said polygonal shape comprises a non-equilateral pentagon, hexagon or octagon.

20. The baseball playing area cover as recited in claim 1 wherein said weight is remote from, but secured to, said flexible material.

21. The baseball playing area cover as recited in claim 20 wherein said weight is permanently retained in said perimeter.

22. The baseball playing area cover as recited in claim 1 wherein said weight is received in a plurality of weight-receiving areas extending between a plurality of points on said perimeter.

23. The baseball playing area cover as recited in claim 1 wherein said weight is comprises at least one of a chain, pellets, sand, earth, rock, concrete, aggregate, polymer, a second fabric.

24. The baseball playing area cover as recited in claim 1 wherein said predetermined configuration defines a circumference of at least six feet.

25. The baseball playing area cover as recited in claim 1 wherein said weight is permanently retained in said flexible material.

26. The baseball playing area cover as recited in claim 1 wherein said flexible material comprises at least one of the following: vinyl laminated polyester; coated polyester; polyethylene sheet or woven polyethylene; a vinyl laminated or coated onto a polyester scrim fabric; a vinyl sheet; a vinyl laminated to a polymer woven scrim fabric; a vinyl coated polymer woven scrim; a vinyl laminated or coated onto any receptive fabric scrim; or a polymer laminated or coated onto any receptive fabric scrim.

27. The baseball playing area cover as recited in claim 1 wherein said weight comprises a chain located in a hem around a perimeter of said flexible material.

28. A method for protecting an area of a baseball field utilizing the device of claim 1, said method comprising the steps of:

determining said area of the baseball field to be covered;

adapting a flexible material to have a configuration that corresponds to said area of said baseball field to be covered;

forming said flexible material into said configuration to provide a cover; and causing weight to be retained in said flexible material, said weight retaining said flexible material on said area after the cover has been situated on said area.

29. The method as recited in claim 28 wherein said method further comprises the step of:

selecting said configuration in response to said area of the baseball field to be covered.

30. The method as recited in claim 29 wherein said method further comprises the step of:

selecting a polygonal shape for said configuration.

31. The method as recited in claim 29 wherein said method further comprises the step of:

selecting a trapezoid shape for said configuration.

32. The method as recited in claim 28 wherein said method comprises the step of:

causing a chain to be located in a hem around a perimeter of said flexible material to provide said weight.

33. The method as recited in claim 28 wherein said determining step comprises the step of determining said area to be an infield area of the baseball field.

* * * * *